US007406231B1

(12) United States Patent
Beck et al.

(10) Patent No.: US 7,406,231 B1
(45) Date of Patent: Jul. 29, 2008

(54) ELECTROLUMINESCENT PATCH CABLE

(75) Inventors: Alexander John Gray Beck, Freches Forest (AU); Jonathan R. Yee-Hang Choy, Wahroonga (AU); Alexander Martin Scholte, Chatswood (AU); David Preshan Thambiratnam, Ashfield (AU)

(73) Assignee: Avaya Technology Corp., Basking Ridge, NJ (US)

( * ) Notice: Subject to any disclaimer, the term of this patent is extended or adjusted under 35 U.S.C. 154(b) by 213 days.

(21) Appl. No.: 11/225,232

(22) Filed: Sep. 12, 2005

Related U.S. Application Data

(60) Provisional application No. 60/692,868, filed on Jun. 21, 2005.

(51) Int. Cl.
*H01B 11/22* (2006.01)

(52) U.S. Cl. ..... 385/100; 385/101

(58) Field of Classification Search ..... None
See application file for complete search history.

(56) References Cited

U.S. PATENT DOCUMENTS

| | | | |
|---|---|---|---|
| 4,890,102 | A | 12/1989 | Oliver |
| 4,978,317 | A | 12/1990 | Pocrass |
| 5,081,627 | A | 1/1992 | Yu |
| 5,198,664 | A | 3/1993 | Fayfield |
| 5,249,183 | A | 9/1993 | Wong et al. |
| 5,577,023 | A | 11/1996 | Marum et al. |
| 5,741,152 | A | 4/1998 | Boutros |
| 5,764,043 | A | 6/1998 | Czosnowski et al. |
| 5,869,930 | A | 2/1999 | Baumberg et al. |
| 5,876,863 | A | 3/1999 | Feldman et al. |
| 6,577,243 | B1 | 6/2003 | Dannenmann et al. |
| 6,596,943 | B1 * | 7/2003 | Ward ..... 174/112 |
| 6,851,818 | B2 | 2/2005 | Sharon et al. |

OTHER PUBLICATIONS

Lasermate Group, Inc. Http://www.lasermate.com/ELproducts.htm; printed Sep. 13, 2005; 3 pages.
Rogers Corporation Data Sheet "D371A Electroluminescent Lamp Driver IC" 15 pages.
Glowire Electroluminescent Wire website www.glowire.com 5 pages printed Feb. 11, 2005.
CooLight Electroluniescent Wire website www.coolight.com 6 pages printed Feb. 11, 2005.
Being Seen Technologies, Inc. website www.beingseen.com 10 pages printed Feb. 11, 2005.
laserVisions—Electric Vinyl light website www.electricvinal.com/shop/com_e_luninous_01.php 3 pages printed Feb. 11, 2005.

* cited by examiner

*Primary Examiner*—Sung H Pak
(74) *Attorney, Agent, or Firm*—Sheridan Ross P.C.

(57) ABSTRACT

The present invention provides an interconnect cable having an electroluminescent element disposed therein in order to facilitate locating the interconnect cable. The electroluminescent element is activated by a driver that may be selectively applied to specified driver ports located on end connectors of the cable. The electroluminescent element may be incorporated within the entire length of the cable, or only along selected sections of the cable.

38 Claims, 2 Drawing Sheets

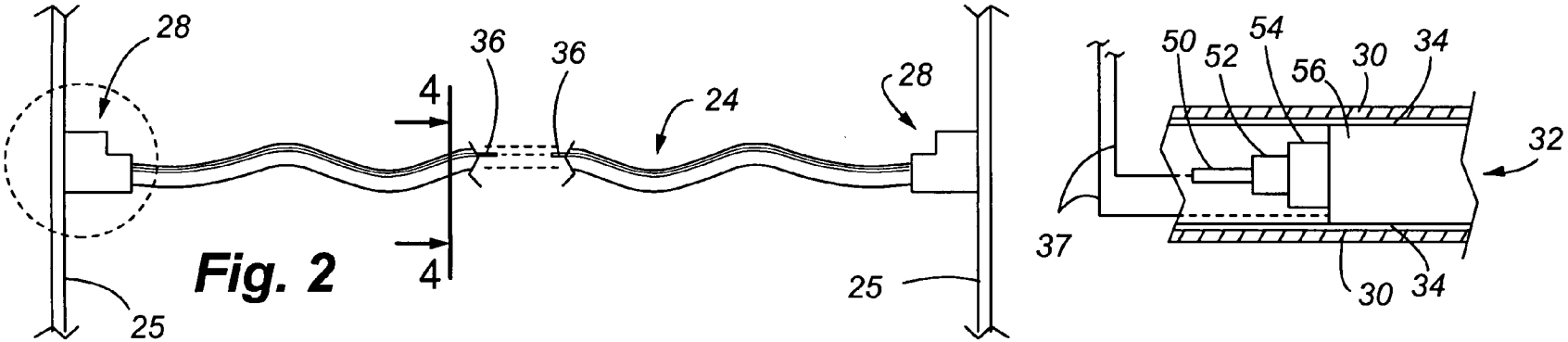
Fig. 2
Fig. 3A
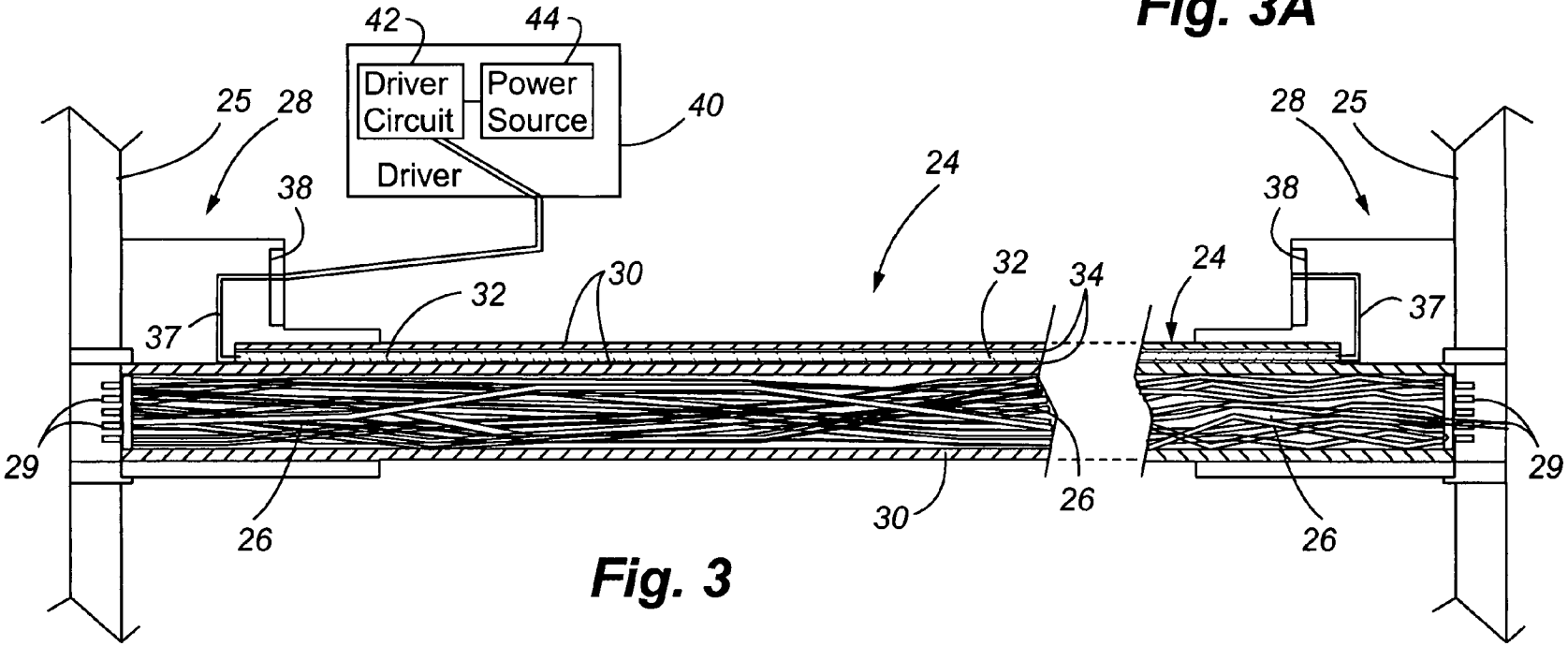
Fig. 3

ELECTROLUMINESCENT PATCH CABLE

CROSS-REFERENCE TO RELATED APPLICATION

This Application claims the priority of U.S. Provisional Application No. 60/692,868 filed on Jun. 21, 2005, the entire disclosure of which is hereby incorporated by reference.

FIELD OF THE INVENTION

The present invention is directed to identification of cables that carry electronic signals, and more particularly, the present invention is directed to the identification of patch cables, such as those used in computer and communication networks.

BACKGROUND OF THE INVENTION

Computer and communication networks rely on patch or interconnect cables to connect components of the networks to one another. To facilitate troubleshooting, maintenance, and reconfiguration of signal paths used within the networks, it is critical that each and every interconnect cable be identified as to its origination and termination. This identification requires recordation of each and every connection. In networks with a large number of interconnected components, keeping accurate track of and managing the connections becomes a significant effort. Network problems may occur if interconnections are not accurately and timely recorded.

In the maintenance of patch panels, paper-based documentation is still widely used. With large networks, the documentation may be recorded in the form of record books where each of the connections are manually recorded. Paper-based documentation obviously has disadvantages in terms of required effort and accuracy.

Verifying existing connections when network problems arise can be extremely time consuming. When a cable has become inadvertently disconnected from its patch panel, or in the attempt to identify a particular cable within a large network, the recorded documentation may provide some assistance, but the documentation alone does not locate the actual position of the cable or its path between connected components.

Automated systems have been developed for monitoring and recording cable connections; however, these known systems require specialized patch panels that monitor connections at the panel, displays on patch panel racks, and LEDs on patch panel ports. Additionally, such systems require special software for administering the patch panel connections. These systems are still deficient in providing the capability to locate an end of a cable that has become disconnected from its port, or a cable that is connected to a port other than the port recorded as being the designated port for the particular cable.

SUMMARY OF THE INVENTION

In accordance with the present invention, an electroluminescent patch or interconnect cable is provided that quickly and easily allow a user to identify not only the ends of the interconnect cable, but also the actual path that the interconnect cable travels.

An electroluminescent fiber is incorporated within the patch cable, preferably partially covered by or encapsulated within the sheath of the interconnect cable. As understood in the art, an electroluminescent fiber or element generally refers to a light producing device wherein a pair of electrodes combined with a semi conductive material, such as phosphor, produce light when an electrical current is applied across the electrodes due to exitation of the phosphor material. Electroluminescent elements are also referred to as cold illumination sources that generally have low operating current requirements, and have a long service life in comparison to conventional light bulbs.

The interconnect cable further includes an end connector attached at each end of the cable enabling it to be plugged into the designated panels/components. A driver port is incorporated on each end connector. In order to activate the electroluminescent fiber, a driver is coupled to a selected one of the driver ports. Regardless of whether the end connectors are engaged with a port of a patch panel/component, or are disconnected from a patch panel/component, the user may activate the electroluminescent fiber by applying the driver to one of the driver ports thereby illuminating the portion of the cable in which the electroluminescent fiber is incorporated.

Preferably, the driver is provided in the form of a portable device that may be hand carried to the work site, the device including a driver circuit and a power supply. The driver circuit conditions the output of the power supply to match the activation requirements of the electroluminescent fiber to be activated.

In one preferred embodiment, the electroluminescent fiber extends the entire length of the interconnected cable. Thus, when the fiber is activated, the entire length of the cable is illuminated.

In another embodiment, the electroluminescent fiber may be segmented, and may be incorporated to extend only along selected lengths of the interconnect cable. For example, it may only be necessary to provide illumination at the ends of the cable. Accordingly, the electroluminescent fiber could be provided in two separate segments, one segment being incorporated at each end of the cable. If the fiber is to be provided in segments or sections, the separated segments or sections are joined by a conductor that transmits the driver signal to each of the separated sections.

The type of electroluminescent fiber may be chosen which provides the desired illumination intensity, as well as color. When the electroluminescent fiber is incorporated within a sheath of the interconnect cable, the sheath must be at least translucent thereby allowing the electroluminescent fiber to transmit light therethrough.

Additional features and advantages of the present invention will become more apparent from a review of the following detailed description, taken in conjunction with the accompanying drawings.

BRIEF DESCRIPTION OF THE DRAWINGS

FIG. 2 is a schematic depiction of an interconnect cable in accordance with embodiments of the present invention;

FIG. 3 is an enlarged longitudinal cross-section of FIG. 2;

FIG. 3A is a greatly enlarged cross-section of a portion of FIG. 3;

DETAILED DESCRIPTION

Figure 1:
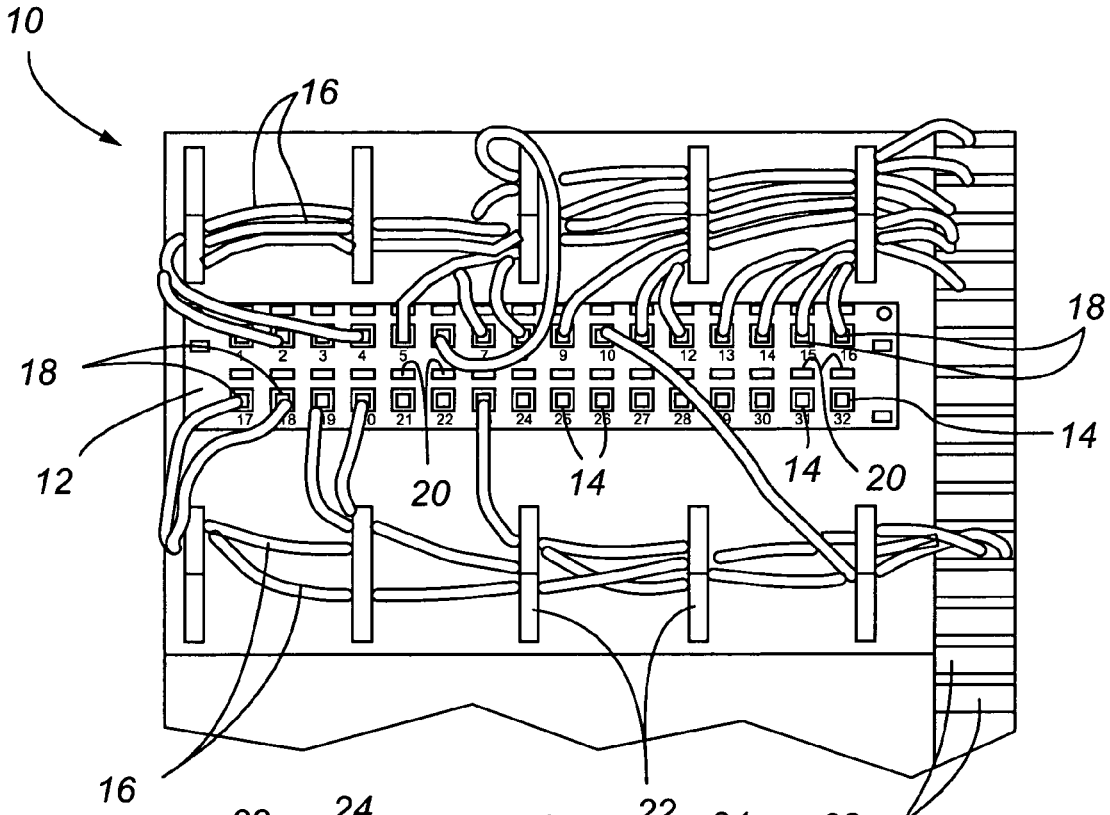
Fig. 1 Prior Art
FIG. 1 illustrates a standard patch panel including a plurality of interconnect cables connected to the patch panel.

Referring to FIG. 1, a prior art patch panel 10 is shown having a mounting plate 12 along with a plurality of numbered connector ports 14 integrated therein. Interconnect cables 16 have corresponding end connectors 18 that are plugged in the respective connector ports 14. For clarity of illustration, not all of the connector ports are shown with corresponding interconnect cables. The connector ports 14 may be identified by their corresponding number, and may further include port identifiers 20 that serve as additional indicia for identifying the particular connector port.

Various cable keepers 22 may be mounted adjacent to the patch panel 10 in order to more orderly maintain the interconnect cables in place; however, as one can appreciate, when a particular patch panel has a great number of interconnect cables connected thereto, the cables become an unmanageable tangle. In some patch panels, particularly in laboratory environments, there may be hundreds of interconnect cables present, making it difficult to troubleshoot and maintain the panel because of the large number of cables present.

Referring to FIGS. 2-5, the electroluminescent patch cable and system of the present invention are illustrated. FIG. 2 illustrates an interconnect cable 24 that interconnects a pair of components 25, such as a patch panel, server computer, switch board, or other known computer or communication components. The interconnect cable 24 features a connector 28 attached at opposite ends of the cable. The interconnect cable 24 has a sheath 30, and one or more signal lines 26 housed within the sheath.

In general, the connectors 28 are configured to interconnect with a mating connector port incorporated upon the network component 25. Accordingly, it will be appreciated that the interconnect cable 24 can be deployed to permit signals and/or power to be passed between the components 25.

Furthermore, it shall be understood that the particular type of interconnect cable to be provided may be in the form of a ribbon cable, or any other particular configuration as dictated or suggested by the particular application.

With reference particularly to FIG. 3, the arrangement of the interconnect cable 24 is shown in more detail. Each end connector 28 includes a mechanical mating structure 38, which may include interconnection points, pins, contact points or some other structure. FIG. 3 generally illustrates mating structure in the form of pins 29 which allow the ends of the interconnect signal lines 26 to operably connect to the components 25. The signal lines 26 may comprise electrically conductive signal or optical signal lines. Thus, the interconnect cable 24 in accordance with the embodiments of the present invention may function to operably interconnect devices/components 25 by transferring signals over the signal lines 26.

FIG. 3 also schematically illustrates driver conductors 37 that interconnect the electroluminescent element 32 to a driver receptacle 38. Preferably, each end connector may incorporate a driver receptacle to permit activation of the element 32 at either end of the cable. A driver 40 engages the interconnect cable via one of the driver receptacles 38. The driver 40 provides the specified power for activating the electroluminescent element. FIG. 3 further illustrates an elongate, tubular shaped electroluminescent element having its own cover or sheath 34 that surrounds the electroluminescent element. The sheath/cover 34 may be made of a flexible plastic, vinyl, or other flexible material having a desired color that therefore allows a desired colored light to be emitted from the electroluminescent element.

Figure 6:
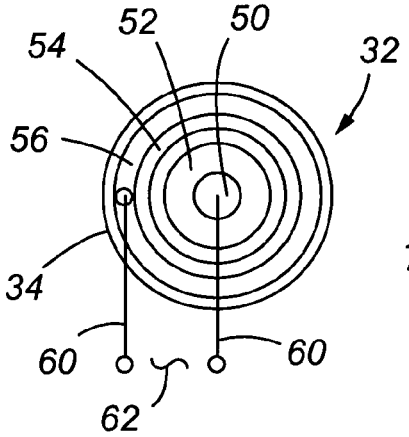
Fig. 6 Prior Art
FIG. 6 illustrates a prior art electroluminescent fiber construction.
Figure 7:
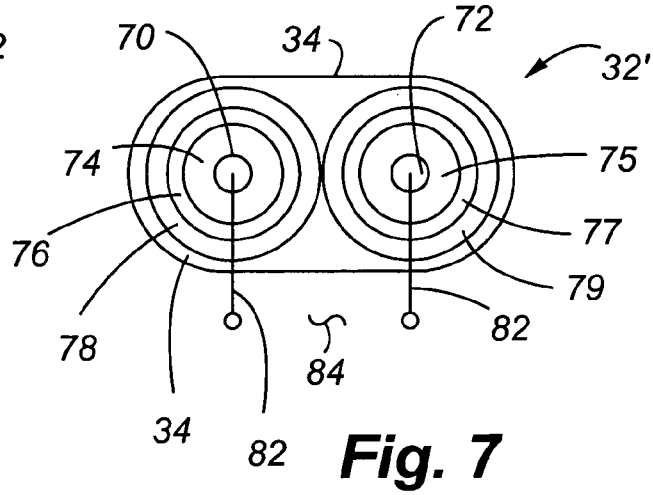
Fig. 7 Prior Art
FIG. 7 illustrates another prior art electroluminescent fiber construction.

FIGS. 6 and 7 illustrate example constructions of electroluminescent elements that may be used with the present invention. These constructions correspond to those disclosed in the U.S. Pat. No. 6,851,818, this reference being incorporated herein in its entirety for purposes of disclosure of the constructions. Although specific examples are provided in FIGS. 6 and 7, it shall be understood that the electroluminescent element of the present invention can be made with other alternative constructions. Therefore, these particular constructions shall not be interpreted as limiting the electroluminescent fiber of the present invention to a particular construction.

Referring to FIG. 6, a single filament construction is shown. It includes a central wire conductor 50 serving as the inner electrode, an insulating layer 52, a phosphor layer 54 placed over the insulating layer, and a layer 56 of transparent material having high electrical conductivity and serving as the outer electrode of the electroluminescent fiber. Layer 56 is electrically connected to one side of a voltage source 62 by a wire 60 connected to layer 56, and the opposite side of the voltage source 62 is connected to the inner electrode 50. An electrical field is generated for creating luminescence in the phosphor layer 54. The single filament construction illustrated also further includes the outer light conductive sheath or cover 34 of uncolored or color transparent plastic material to permit transmission therethrough of the light generated within the electroluminescent fiber. The voltage source in the preferred embodiment is provided by the output of driver 40. The voltage source may be AC, or a pulsed DC. Thus, the electroluminescent element shown in FIG. 6 can be described essentially as a capacitor with one transparent electrode and a special phosphor material in a dielectric. The phosphor glows when a voltage source is applied across the electrodes.

FIG. 7 illustrates another prior art construction for an electroluminescent fiber. More specifically, FIG. 7 illustrates a two-filament construction, therein generally designated as 32'. In this construction, there are two inner electrodes 70 and 72, each constituting one of the two light generating filaments of the electroluminescent element. Each, filament further includes respective insulating layers 74 and 75, respective phosphor layers 76 and 77, and respective transparent electrically conductive layers 78 and 79. Conductors 82 are used to apply a voltage 84 to the inner electrodes 70 and 72. The outer light conductive sheath or cover 34 encloses both of the filaments to produce a relatively flat electroluminescent element having the two light generating filaments therein. Use of two light generating filaments produces a higher light output.

Referring to FIG. 3A, the connection between the electrodes of the electroluminescent element and the conductors 37 are illustrated. More specifically, FIG. 3A illustrates the present invention adopting the particular construction of the electroluminescent fiber shown in FIG. 6. Accordingly, it is shown that the inner electrode 50 and the outer electrode 56 are electrically coupled to the conductors 37 so that when the driver 40 is engaged with the driver port 38, power is provided to the electroluminescent element 32.

Figure 4:
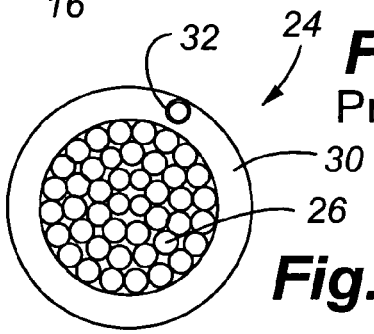
FIG. 4 is a transverse cross-section of the interconnect cable taken along line 4-4 of FIG. 2.

Referring to FIG. 4, a cross-section is illustrated wherein the sheath 30 surrounds the plurality of signal lines 26. The electroluminescent element 32 is shown as being encapsulated within the sheath 30, thus, the cable maintains a substantially round cross-section. One manner in which to incorporate the electroluminescent element within the sheath 30 is to emplace the element 32 during the molding process of the sheath. Those skilled in the art can envision other ways in which the element 32 may be efficiently formed with the sheath 30.

Figure 5:
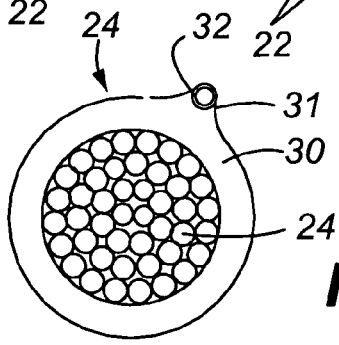
FIG. 5 illustrates a transverse cross-section of another embodiment of the present invention.

In yet another embodiment of the present invention as shown in FIG. 5, the electroluminescent element 32 may have some portion that remains exposed, and the remaining portion of the electroluminescent element being attached to the sheath. Therefore, the sheath 30 would not have to be translucent or transparent. More specifically, a portion of the sheath 30 that contacts the electroluminescent element 32 has a radial extension 31 that captures the electroluminescent element, but leaves some portion of the outer surface of the electroluminescent element exposed. Accordingly, the sheath 30 does not have to be translucent or transparent, and the portion of the electroluminescent element exposed adequately transmits light.

As mentioned above, the driver 40 in accordance with embodiments of the present invention includes a power source 42 and driver circuit 44. The driver circuit 44 modulates the signal provided by the power source 42 in order to match the activation requirements of the electroluminescent element. It is also contemplated within the present invention that the driver 40 could include a manual switch (not shown) that would allow a user to set the driver 40 to provide the correct power for activation of the electroluminescent element. Preferably, the driver 40 would be a hand-held device having an extension that would conveniently fit within the driver receptacle 38. By attaching the driver 40 to the receptacle 38, electrical connection would be made between the output of the driver and the conductor 36 thereby activating the electroluminescent element.

In some circumstances, it is desirable to incorporate the electroluminescent element 32 along the entire length of the interconnect cable. In other circumstances it may only be necessary to incorporate the electroluminescent element along selected lengths of the interconnect cable, such as providing the electroluminescent element in two separate segments or sections which extend from the respective end connectors 28. If the electroluminescent element 32 is to be segmented or separated, the separated segments or sections may be electrically connected by conductors 36, as shown in FIG. 2. The conductors 36 could simply include a pair of wire conductors interconnecting the electrodes of the separated segments thereby conveying power between the separated segments for activation.

The advantages of the present invention are clear. Electroluminescent patch cables have been provided that enable a user to positively identify the origination and termination of a particular cable, as well as to trace the path of the cable as it may extend through a complex bundle or group of cables used in a large network. The visual indication provided by the electroluminescent fiber provides an easy means of identification for the user, yet the identification does not require expensive hardware, software, or other supporting components. A hand-held driver also makes identification of cables quick and efficient, and does not require the user to disconnect any cables or otherwise modify or interrupt the particular network in which the cables are found.

The particular embodiments described above are intended to explain the best mode presently known in practicing the invention and to enable others skilled in the art to utilize the invention in such or in other embodiments and with various modifications required by their particular application or use of the invention. Therefore, it is intended that the appended claims be construed to include the alternative embodiments to the extent permitted by the prior art.

What is claimed is:

1. A system for identifying ends of an interconnect cable, said system comprising:

an interconnect cable having a first end connector attached at one end of said cable, a second end connector attached at an opposite end of said cable, an outer sheath, and at least one signal conductor disposed within said sheath;

an electroluminescent fiber encapsulated within said sheath of said cable;

a driver communicating with said electroluminescent fiber for selectively activating said electroluminescent fiber thereby providing illumination to identify a path of the interconnect cable; and said first and second end connectors each include (i) a plurality of connector pins, (ii) a driver port for receiving said driver, said driver port being positioned remote from said pins and outside of said sheath, and (iii) a driver conductor mounted in said end connector and interconnecting said driver to said fiber.

2. A system, as claimed in claim 1, wherein:

said fiber further includes an outer light transmissive cover of a desired color.

3. A system, as claimed in claim 1, wherein:

said driver is a portable device that is selectively connected to said first or second connector in order to activate said fiber.

4. A system, as claimed in claim 1, wherein:

said interconnect cable has a substantially circular cross-section.

5. A system, as claimed in claim 1, wherein:

said interconnect cable has a cross-section of a substantially non-circular shape.

6. A system, as claimed in claim 1, wherein:. said driver produces a voltage for activating said fiber.

7. A system, as claimed in claim 1, wherein:

said driver includes a power supply and a driver circuit, said driver circuit controlling a voltage output of said power supply to match requirements for activating said fiber.

8. A system, as claimed in claim 1, wherein:

said fiber extends a length of said interconnect cable.

9. A system, as claimed in claim 1, wherein:

said fiber extends a partial length of said interconnect cable.

10. A system, as claimed in claim 1, wherein:

said fiber includes a plurality of fiber sections spaced from one another along a length of said interconnect cable, said sections being interconnected by a fiber conductor.

11. A system, as claimed in claim 7, wherein:

said power supply produces a direct current voltage source to activate said fiber.

12. A system, as claimed in claim 7, wherein:

said driver circuit comprises a signal modulator that operates to modulate a current provided by said power supply.

13. An interconnect cable comprising:

a first end connector attached at one end of said cable;

a second end connector attached at an opposite end of said cable;

an outer sheath;

at least one signal conductor disposed in said sheath;

an electroluminescent fiber partially encapsulated within said outer sheath, said electroluminescent fiber producing light when activated by a power source; and said first and second end connectors each include (i) a plurality of connector pins, (ii) a driver port for receiving said power source said driver port being position remote from said pins and outside of said outer sheath; and (iii) and a driver conductor mounted in said end connector and interconnecting said power source to said fiber.

14. An interconnect cable, as claimed in claim 13, wherein: said fiber further includes an outer light transmissive cover of a desired color.

15. An interconnect cable, as claimed in claim 13, wherein: said interconnect cable has a substantially circular cross-section.

16. An interconnect cable, as claimed in claim 13, wherein: said interconnect cable has a cross-section of a substantially non-circular shape.

17. An interconnect cable, as claimed in claim 13, wherein: said fiber extends a length of said interconnect cable.

18. An interconnect cable, as claimed in claim 13, wherein: said fiber extends a partial length of said interconnect cable.

19. An interconnect cable, as claimed in claim 13, wherein: said fiber includes a plurality of fiber sections spaced from one another along a length of said interconnect cable, said sections being interconnected by a fiber conductor.

20. A system for identifying ends of an interconnect cable, said system comprising:

an interconnect cable having a first end connector attached at one end of said cable, a second end connector attached at an opposite end of said cable, an outer sheath, and a plurality of signal conductors disposed within said sheath;

an electroluminescent fiber mounted to said outer sheath;

means for selectively activating the fiber placed in electrical communication with said electroluminescent fiber that provides illumination to identify a path of the interconnect cable; and said end conductors each having a plurality of connection pins and a driver port positioned remote from the connection pins and mounted exteriorly of the sheath for receiving the means for selectively driving the fiber.

21. A system, as claimed in claim 20, wherein: said fiber further includes an outer light transmissive cover of a desired color.

22. A system, as claimed in claim 20, wherein: said interconnect cable has a substantially circular cross-section.

23. A system, as claimed in claim 20, wherein: said interconnect cable has a cross-section of a substantially non-circular shape.

24. A system, as claimed in claim 20, wherein: said fiber extends a length of said interconnect cable.

25. A system, as claimed in claim 20, wherein: said fiber extends a partial length of said interconnect cable.

26. A system, as claimed in claim 20, wherein: said fiber includes a plurality of fiber sections spaced from one another along a length of said interconnect cable, said sections being interconnected by a fiber conductor.

27. A system, as claimed in claim 20, wherein: said fiber is encapsulated within said sheath.

28. A method of identifying a location of an interconnect cable, said method comprising the steps of:

providing an interconnect cable having an outer sheath, first end connector attached at one end of the cable, and a second end connector attached at an opposite end of said cable;

said first and second end connectors each include (i) a plurality of connection pins; (ii) a driver port for receiving said driver, and (iii) a driver conductor interconnecting said driver to said fiber, said driver port being positioned remote from said connection pins and mounted externally of said sheath;

providing an electroluminescent fiber integral with the sheath of the interconnect cable;

providing a driver for activating the electroluminescent fiber; and applying said driver to the driver port thereby illuminating the interconnect cable.

29. A method, as claimed in claim 28, wherein: said fiber further includes an outer light transmissive cover of a desired color.

30. A system, as claimed in claim 28, wherein; said driver is a portable device that is selectively connected to said first or second connector in order to activate said fiber.

31. A system, as claimed in claim 28, wherein: said driver produces a voltage for activating said fiber.

32. A system, as claimed in claim 28, wherein: said driver includes a power supply and a driver circuit, said driver circuit controlling a voltage output of said power supply to match requirements for activating said fiber.

33. A system, as claimed in claim 28, wherein: said fiber extends a length of said interconnect cable.

34. A system, as claimed in claim 28, wherein: said fiber extends a partial length of said interconnect cable.

35. A system, as claimed in claim 28, wherein: said fiber includes a plurality of fiber sections spaced from one another along a length of said interconnect cable, said sections being interconnected by a fiber conductor.

36. A system, as claimed in claim 28, wherein: said power supply produces a direct current voltage source to activate said fiber.

37. A system, as claimed in claim 28, wherein; said driver circuit comprises a signal modulator that operates to modulate a current provided by said power supply.

38. A system, as claimed in claim 28, wherein: said fiber is encapsulated within said sheath.

* * * * *